United States Patent [19]

Batch et al.

[11] Patent Number: 5,031,374

[45] Date of Patent: Jul. 16, 1991

[54] MULTIPLE PANEL METAL ROOFING SYSTEM

[75] Inventors: Gregory K. Batch; Ronald W. Batch, both of Stockton; Keith L. Shroyer, Lodi; Peter F. Busalacchi; Billy F. Kobus, both of Stockton, all of Calif.

[73] Assignee: Roentec Corporation, Stockton, Calif.

[21] Appl. No.: 406,654

[22] Filed: Sep. 13, 1989

[51] Int. Cl.[5] ..... E04B 7/00; E04D 3/36; E04D 11/02; E04G 23/00

[52] U.S. Cl. ..... 52/410; 52/58; 52/22; 52/408; 52/460; 52/461; 52/462; 52/713; 52/714; 52/747

[58] Field of Search ..... 52/58, 60, 22, 408, 52/410, 460–462, 467, 713–714, 747

[56] References Cited

U.S. PATENT DOCUMENTS

| | | | |
|---|---|---|---|
| 195,254 | 9/1877 | Benedict | 52/467 |
| 232,300 | 4/1958 | Jacobson | 52/409 |
| 1,451,639 | 4/1923 | White | 52/467 |
| 2,799,232 | 7/1957 | Jaeger | 52/409 |
| 2,885,743 | 5/1959 | Macormack | 52/467 X |
| 2,974,078 | 3/1961 | Petritz et al. | 52/417 |
| 3,245,179 | 4/1966 | Hawkins | 52/410 |
| 3,332,186 | 7/1967 | Cammaert | 52/302 |
| 3,353,316 | 11/1967 | Berg | 52/302 |
| 3,453,793 | 7/1969 | Salton | 52/461 |
| 3,495,363 | 2/1970 | Johnson | 52/94 |
| 3,958,373 | 5/1976 | Stewart et al. | 52/58 |
| 4,018,017 | 4/1977 | Schoop | 52/58 X |
| 4,063,395 | 12/1977 | Stewart et al. | 52/349.5 |
| 4,075,806 | 2/1978 | Alderman | 52/403 |
| 4,106,245 | 8/1978 | Lowe | 52/90 |
| 4,112,632 | 9/1978 | Simpson | 52/11 |
| 4,162,597 | 7/1979 | Kelly | 52/410 |
| 4,192,108 | 3/1980 | Lowe | 52/90 |
| 4,235,058 | 11/1980 | Patry | 52/408 |
| 4,244,151 | 1/1981 | Seem | 52/60 |
| 4,389,826 | 6/1983 | Kelly | 52/410 |
| 4,423,572 | 1/1984 | Tor | 52/94 |
| 4,445,305 | 5/1984 | Orie, Sr. | 52/309.8 |
| 4,493,175 | 1/1985 | Coppola, Jr. | 52/410 |
| 4,520,606 | 6/1985 | Francovitch | 52/410 |
| 4,548,002 | 10/1985 | Murray | 52/22 |
| 4,592,183 | 6/1986 | See | 52/309.4 |
| 4,608,791 | 9/1986 | McClure | 52/90 |
| 4,619,100 | 10/1986 | Emblin | 52/748 |
| 4,620,397 | 11/1986 | Simpson et al. | 52/66 |
| 4,625,469 | 12/1986 | Gentry et al. | 52/60 X |
| 4,631,878 | 12/1986 | Laramore | 52/90 |
| 4,736,561 | 4/1988 | Lehr et al. | 52/410 |
| 4,741,132 | 5/1988 | Emblin | 52/58 |
| 4,793,116 | 12/1988 | Whitman | 52/410 X |
| 4,831,794 | 5/1989 | Perry | 52/22 X |
| 4,860,514 | 8/1989 | Kelly | 52/410 |
| 4,897,974 | 2/1990 | Lane | 52/58 |

FOREIGN PATENT DOCUMENTS

| | | | |
|---|---|---|---|
| 544599 | 7/1928 | Fed. Rep. of Germany | 52/410 |
| 3010167 | 9/1981 | Fed. Rep. of Germany | 52/58 |

OTHER PUBLICATIONS

*The Roof of the Future Today.* Industrial Roofing Systems Brochure.

Council of American Building Officials, Report No. NRB-171, Aug. 1982.

*Primary Examiner*—John E. Murtagh

*Assistant Examiner*—Deborah McGann Ripley

*Attorney, Agent, or Firm*—Townsend and Townsend

[57] ABSTRACT

A new roofing system (14) for installation on a structure (2) whose existing roof deck (6) and membrane (12) may include depressed regions (8, 10) compensates for the depressed regions with contour cut compensation panels (18). Filler panels (20) are placed atop the roof deck, membrane and any required compensation panels, with opposed perimeter edges (64) of adjacent filler panels abutting. The filler panels are secured to the underlying roof deck with anchor plates (22) and screws (70), one anchor plate preferably securing four adjacent filler panels at the junction of their corners. The filler panels may have uniform thickness (58) or, if a sloped roofing system is to be fabricated, they may have non-uniform thickness (60, 62). Lengths (82, 88) of roofing material (76), such as galvanized metal, are laid atop the upper surface (72) of the filler panels and anchor plates and are secured to the anchor plates with screws (92). A coating (110) is applied to the upper side of the roofing material to seal the installation and to encapsulate any asbestos contained in the existing deck.

44 Claims, 9 Drawing Sheets

MULTIPLE PANEL METAL ROOFING SYSTEM

BACKGROUND OF THE INVENTION

This invention relates to roofing systems, and more particularly to prefabricated roof systems for installation on structures with substantially flat (horizontal) roof deck surfaces.

Flat roof installations present many problems not found with structures having inclined roof deck surfaces. In such installations the deck surface is typically not uniformly flat, but exhibits some depressed areas. Unless these areas are compensated for, installation of a conventional prefabricated roof system over such a deck surface may result in the collection or pooling of rain water in the locations of the depressions.

In the prior art, rapid installations of roof systems is rarely possible because substantial on-site construction is often called for. For example, where depressions in the roof deck are present (often indicated by leaks in the previous roof), it is common to construct a gabled structure atop the deck to provide some inclination.

Installation around obstructions such as roof mounted fixtures, vent pipes and the like, is time consuming and the resulting roof-fixture or roof-vent interface is often the site of future water leaks due to relative movement between the roof and the fixture or vent.

Frequently the new roof system is installed atop the pre-existing roof material without removing the same. In the past, the pre-existing roof material often included asbestos for fire retardation. Today it is generally required that the new installation encapsulate the asbestos for reasons of health and safety.

SUMMARY OF THE INVENTION

The present invention is a roofing system that is installed over a structural roof deck that may already be covered with a preexisting roof material or membrane. The new roofing system is relatively light weight, is easy and quick to install, and encapsulates any asbestos present in the preexisting roof.

The present invention preferably frames the edge of the roof deck with hat-shaped perimeter members that are preferably filled with foam for insulation and structural strength. These members may be attached to the deck and adjoining wall surface of the structure. To compensate for any depressions in the roof deck surface, the present invention preferably includes compensation panels whose lower surfaces are contour cut, preferably at the job site using a hot wire, to approximate the shape of any depressed regions. After contour cutting, the compensation panels are laid in place atop the depressed regions. The resulting surface is substantially depression-free for the placement of filler panels.

The roof deck, as defined by the perimeter members, and the upper surface of any compensation panels are then covered with a layer of filler panels, laid side by side. The filler panels, like the compensation panels and the material filling the perimeter hats, are preferably a polystyrene foam material. Such material is light weight and easy to work with, provides thermal insulation and exhibits substantial compressive strength. According to the present invention, the filler panels may be of uniform thickness or may have a varying thickness to establish a slope on the new roofing system. At the region where the filler panels abut the perimeter members, the height of the perimeter members and the filler panels are preferably about equal to keep water from collecting.

Once any compensation panels and the filler panels have been laid in position, they are preferably secured to the roof deck with anchor plates and screws. The anchor plates are preferably positioned at the abutting corners of adjacent filler panels and screws are passed through the anchor plates, through the underlying filler panel and, if required, through the compensation panel, and into the underlying deck. Preferably the screws are tightened sufficiently to bring the upper surface of the anchor plates substantially flush with the upper surface of the filler panels. Thus, when rectangular panels are used, one anchor plate is able to anchor the corner of four filler panels.

Lengths of roofing material, preferably rolled galvanized metal, are laid atop the upper surface of the filler panels and the perimeter members to form an outer skin layer. Preferably adjacent lengths of roofing material overlap each other a marginal amount, with an adhesive caulking compound preferably placed between the overlapping areas to promote watertightness. Fasteners, typically screws, pass through the roofing material in the marginal region and into the anchor plates to secure the outer skin to the deck. At the deck perimeter, screws attach the roofing material to the top of the perimeter members. In addition, sheet metal screws preferably secure the overlapped marginal portions of the outer skins to each other. Optionally an adhesive may be used to attach the roofing material to the underlying filler panels. After the roofing material has been attached, it is preferred that a roof sealing compound be applied to the upper surface of the roofing material. This compound contributes to the sealing or encapsulating of any asbestos particles that may have been present in the underlying deck.

The present invention advantageously provides a readily and economically installed roofing system that encapsulates any asbestos particles in the preexisting roof. Further, the present invention advantageously allows the roof installer to rapidly compensate for depressions in the preexisting roof, and to fabricate, if desired, a sloped roofing system.

Other features and advantages of the invention will appear from the following figures and description, wherein the preferred embodiments are set forth in detail.

DETAILED DESCRIPTION OF THE PREFERRED EMBODIMENTS

Figure 1:
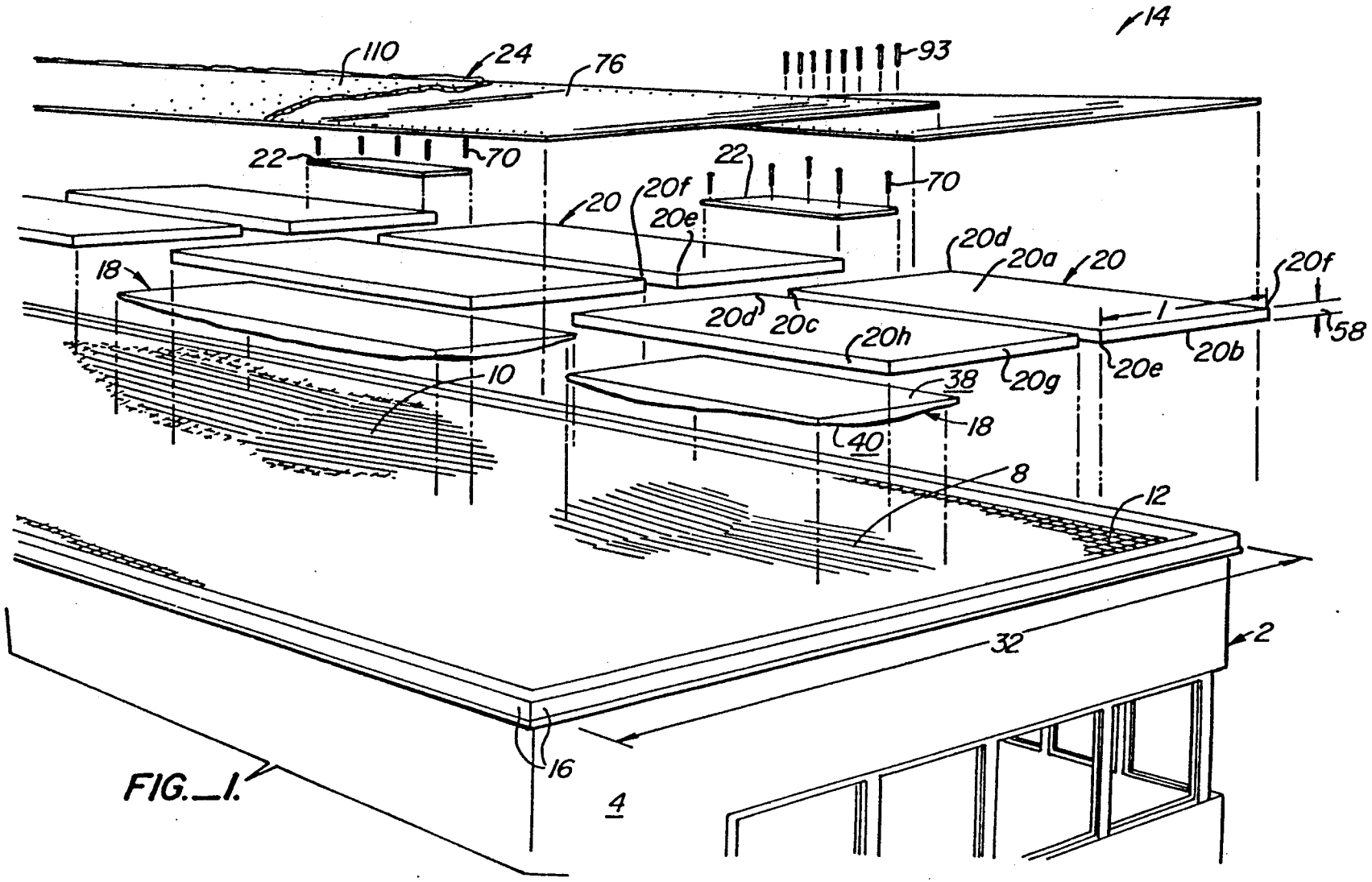
FIG. 1 is an exploded perspective view of a roof installation according to the present invention.

A first preferred embodiment is illustrated in FIG. 1 wherein a structure 2 having walls 4 is covered by a structural roof deck 6, typically made of plywood. As shown, deck 6 frequently has several depressed areas 8, 10 and may already be covered with a preexisting roof membrane 12, which often is no longer water tight, necessitating the installation of a new roofing system shown generally as 14. In older structures 2, membrane 12 may include asbestos, a material representing a known threat to the health and safety of persons coming in contact with the material. It is desired therefor that the new roofing system 14 adequately encapsulate any asbestos particles in membrane 12.

With reference to FIG. 1, the new roofing system 14 includes perimeter members 16, optional compensation panels 18, filler panels 20. anchor plates 22, a roof covering 24, and related fastening hardware.

Figure 2:
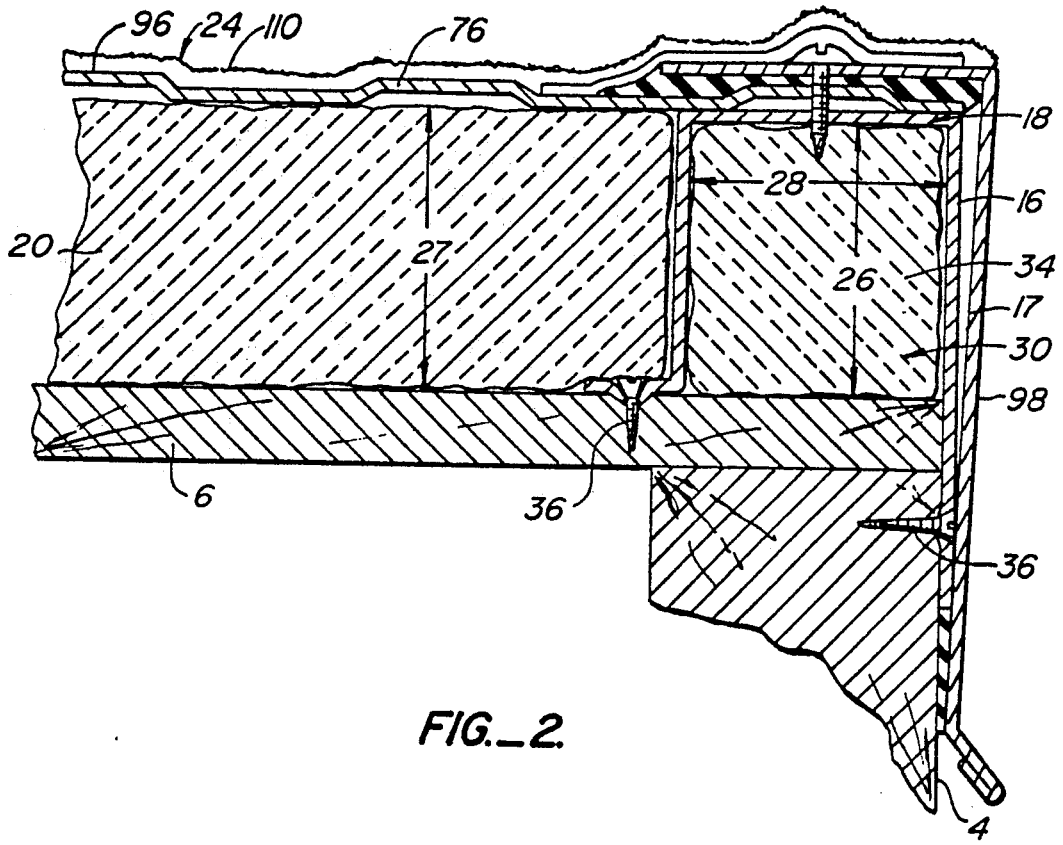
FIG. 2 is a cross section of a perimeter portion of the roof installation show in FIG. 1.

As shown in FIG. 2, perimeter members 16 frame the perimeter of deck 6 and are preferably somewhat hat-shaped in appearance. Members 16 have a height 26, and width 28 which define a hollow area 30 extending the length 32 of member 16. Preferably area 30 is filled with a polystyrene foam 34 which contributes strength to the member 16 as well as providing a measure of thermal insulation. Members 16 are preferably galvanized metal and are attached to deck 6 and/or the walls 4 of structure 2 with nails or screws 36. As shown in FIG. 2, exterior facing side 17 of member 16 is preferably sufficiently long to extend below the level of deck 6 to minimize the chance of water seepage into deck 6 at the interface of side 17 and wall 4.

Figure 3:
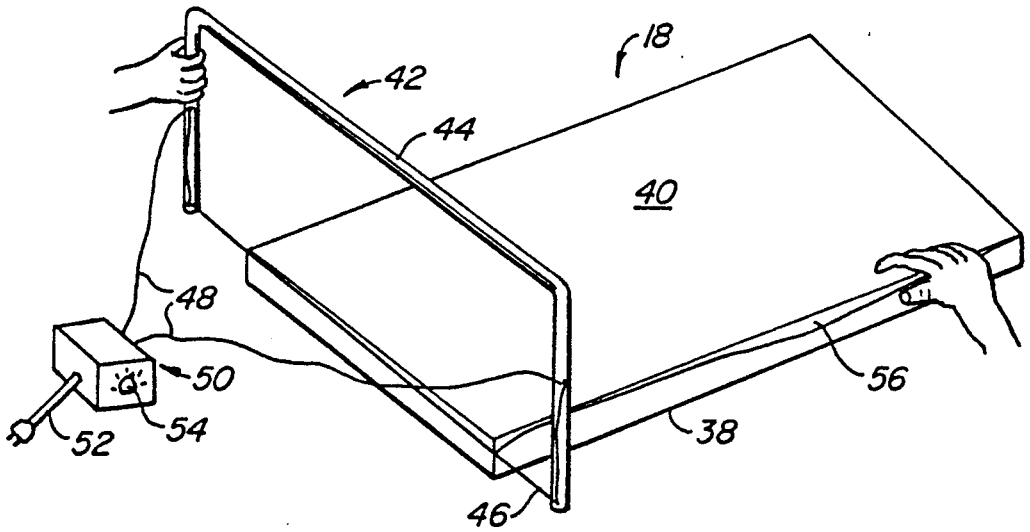
FIG. 3 is a schematic view showing contour cutting of a compensation panel according to the present invention.
Figure 5:
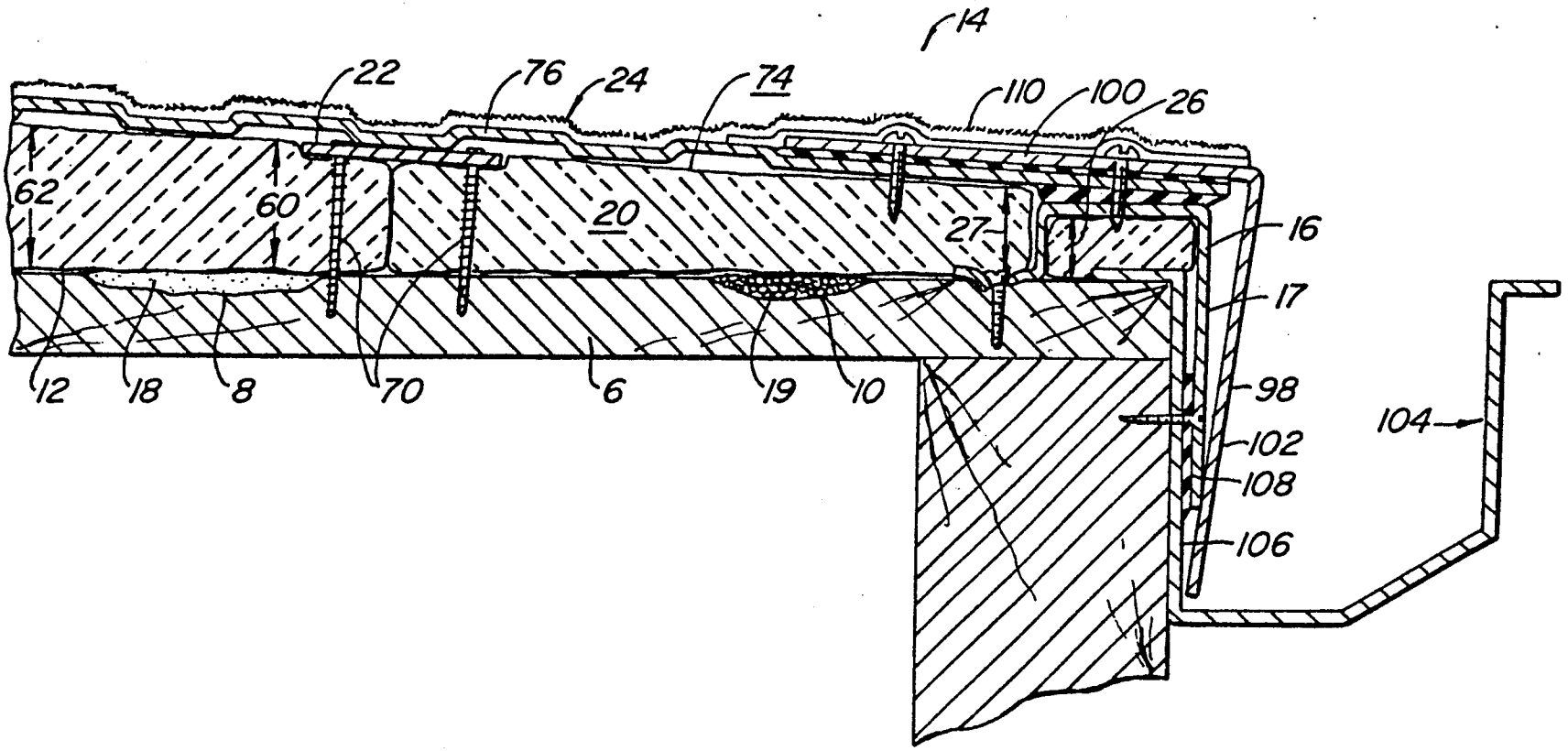
FIG. 5 is a cross section of a perimeter portion of the roof installation shown in FIG. 4.

As noted, it is not unusual for deck 6 to include depressed areas 8, 10 which cause pooling of rain water and promote water leakage into the structure 2. According to the present invention, if such depressed areas 8, 10 are located, the areas 8, 10 are preferably covered with compensation panels 18 which fill the depression. Each compensation panel 18 has an upper surface 38 and a lower surface 40. As shown in FIGS. 1, 3 and 5, the normally flat lower surface 40 of panels 18 is contour cut to match the shape of the underlying depressed area 8, 10, to compensate therefor. After the lower surfaces 40 have been contour cut, compensation panels 18 are simply laid over the depressed areas 8, 10 with the result that the upper surface 38 of panels 18 is essentially flush or coplanar with the remaining exposed surface of deck 6.

Compensation panels 18 are preferably sheets of the same material 34 as was used to fill perimeter members 16. Panels 18 are preferably polystyrene foam, a material that provides thermal insulation and is light weight, easy to work with and yet exhibits good compressive qualities and is strong enough to walk upon. Panels 18 are preferably cut from 4'×8' sheets of such foam, the sheets being available in thicknesses ranging from about 0.5" to about 12", with the density of the foam 34 being about 1–3 lbs/ft$^3$. Although cut from a large sheet of foam, a typical panel 18 at installation may in fact be smaller than 4'×8', depending upon the size of the depressions 8, 10 requiring compensation, and may be other than rectangular in shape.

According to the present invention and as shown in FIG. 3, lower surface 40 of compensation panels 18 are contour cut to match depressed areas 8, 10 preferably using a hot wire cutting apparatus 42. Apparatus 42 includes a frame 44 which holds substantially taut a wire 46 through which electricity is passed via connecting leads 48. Preferably leads 48 are connected to a voltage reducing device such as an SCR controller or a rheostat 50 which receives house current via input leads 52 and provides a controlled magnitude of electricity to leads 48 as determined by a user operated control 54. Preferably wire 46 is piano wire or welding wire with a thickness about equal to that of 30 lb. test monofilament fishing line, and with a length about 4'6" to accommodate the full width of a compensation panel 40.

A user adjusts control 54 on rheostat 50 until wire 46 is sufficiently hot to cut through panel 40. Preferably the contour cutting occurs at the roof site, on deck 6. Because panels 18 may be large, such as 4'×8', contour cutting is generally a two person task. FIG. 3 shows, by way of example only, a compensation panel 18 with contour markings 56 indicating, according to the installer's best initial estimate, where portions of lower surface 40 should be cut away to permit panel 18 to conform to depressions 8, 10 in the deck 6. Although FIG. 3 shows markings 56 for clarity of explanation, an experienced installer may just cut away portions of lower surface 40 without making such markings. Apparatus 42 works equally well where the panel 18 is relatively stationary and the hot wire 46 is moved through panel 18, or where panel 18 is moved through a relatively stationary hot wire 46. It may take several passes with apparatus 44 before lower surface 40 has the proper shape.

In practice, after an initial cutting away, panel 18 is placed over the depressed area and any regions of lower surface 40 requiring further cutting are noted. An installer may choose to stand on upper surface 38 when panel 18 is temporarily in place, causing any unduly "high" regions of lower surface 40 to become somewhat compressed, thereby indicating where additional material should be cut away. If desired a piece of carbon paper or the equivalent could be placed, transfer side up, in depressions 8, 10 and the contour cut panel 18 placed in position, lower side 40 facing down. By walking on surface 38, an installer would cause the carbon paper to transfer carbon marks indicating high points on surface 40 to be cut away. By trial and error, a roof installer can quickly cut away portions of lower surface 40 of compensation panel 18 with apparatus 42 to obtain a substantially good fit. It is to be understood, however, that some roof decks 6 are sufficiently flat and depression free as to not require any compensation panels 18.

Alternatively, as shown in FIG. 5, depressions 8, 10 may also be filled with beads 19 rather than compensation panels 18. Beads 19 are made of foam material and are commonly referred to as polybeads. However, the use of beads 19 becomes very difficult under windy conditions and compensation panels 18 are generally preferred for compensating depressions 8, 10 in deck 6. Instead of beads 19, a hardenable liquid material may be used as well.

After any depressed areas 8, 10 have been compensated for with compensation panels 18 or beads 19, filler panels 20 are placed atop deck 6 and atop the upper surface 38 of any required compensation panels 18 or beads 19 (see FIGS. 1–5). Filler panels 20 are preferably 4'×8' sheets of the same polystyrene foam material as was used for compensation panels 18, the sheet thickness 58 or 62 ranging from about 0.5" to about 12". Filler panels 20 have upper surface 20*a* and lower surface 20*b*, surface 20*b* facing upper surface 38 of compensation panels 18 (when used) or membrane 12. FIG. 1 shows each panel 20 having corners 20*c, d, e,* and *f*. FIG. 1 also shows each panel 20 having peripheral edges 20*g* and 20*h*. The two remaining peripheral edges 20*i* (parallel to edge 20*h*) and 20*j* (parallel to edge 20*g*) are mirror images of edges 20*h* and 20*g*, respectively, and are hidden from view in FIG. 1, Each filler panel 20 preferably has a major length L and minor length 1, preferably 4'×8' as described.

Figure 4B:
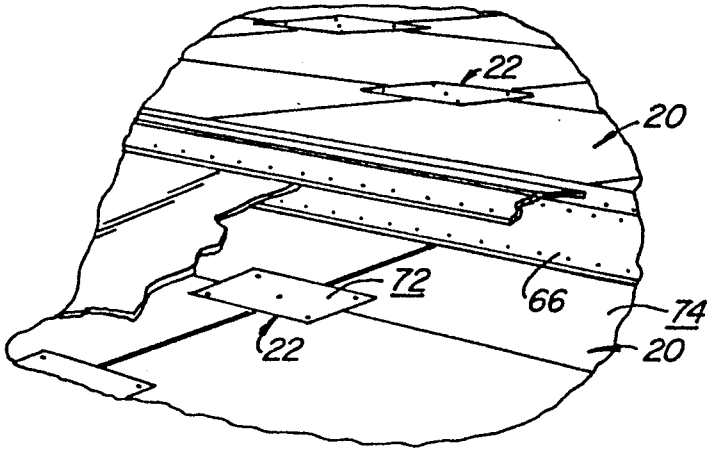
FIG. 4B is a detailed, magnified portion of the sloping roof installation of FIG. 4A.
Figure 4A:
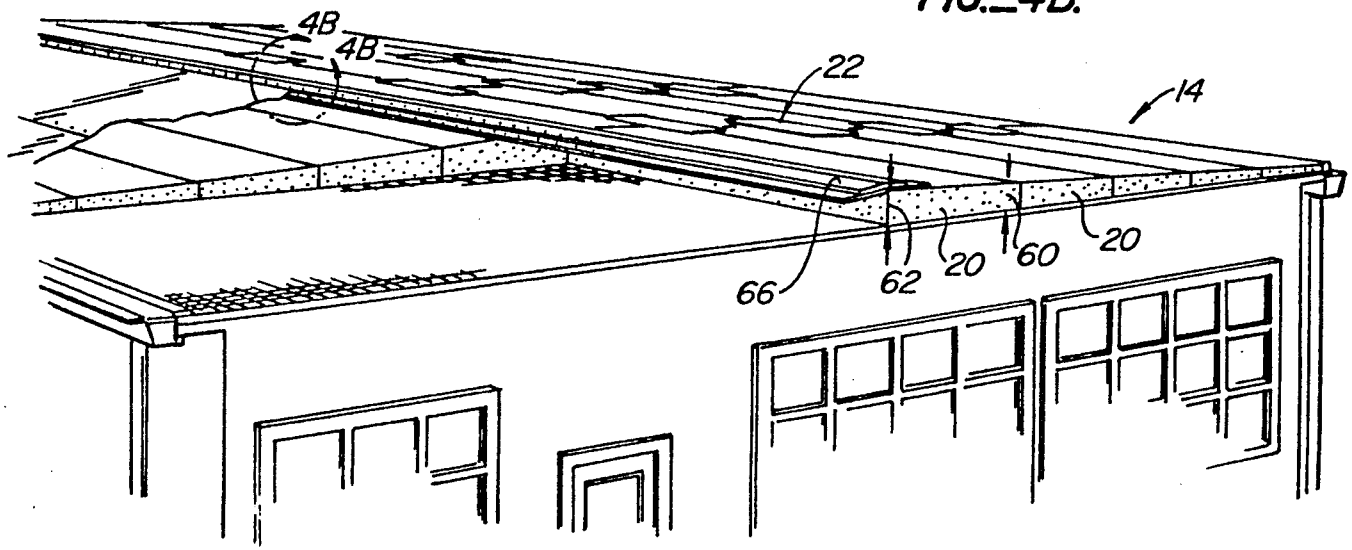
FIG. 4A is a perspective view of a sloping roof installation according to the present invention.

Occasionally, for reasons of esthetics or perhaps to permanently alleviate a problem with water pooling, it may be desired to add a slope to a roof surface. Thus, while FIG. 1 show filler panels 20 having uniform thickness 58 for installation where the new roof is to be substantially parallel to the old deck 6, FIGS. 4A, 4B and 5 show sloping or inclined filler panels 20 having a tapered cross section wherein thickness 60 is less than the thickness 62. Sloping filler panels 20 permit the installation of a roof system 14 having a surface that slopes even though the underlying roof deck 6 may be horizontal. Such a surface is not likely to develop leaks because of water pooling. The sloping or tapered filler panels 20 may be cut by an installer from panels 20 having uniform thickness 62 using the hot wire cutting method above described. As shown in FIG. 4, when installing a sloped roofing system, it is preferred that flashing 66 be included at the apex region to promote watertightness.

As seen in FIGS. 2 and 5, where filler panels 20 abut perimeter members 16, the height 26 of the perimeter member 16 is approximately equal to the height 27 of filler panel 20. Filler panels 20 are laid such that perimeter edges 64 of adjacent panels 20 either abut or adjoin one another. An anchor plate 22 is placed atop panels 20, preferably at the junction of corners 20*c, d, e* and *f* of adjoining panels 20. See FIGS. 1, 6 and 7. Anchor plate 22 could, however, be located elsewhere atop one or more panels 20; this is indicated in FIG. 7 by dashed lined anchor plates 22*a* or 22*b*. So placed, one anchor plate 22 secures up to four filler panels 20. Anchor plate 22 is preferably 24 gauge galvanized steel, and preferably measures about 1'×2'; and optionally includes holes 68 sized to receive screws 70 or similar fasteners. The body of fasteners 70 pass through holes 68, through filler panels 20, through any underlying compensation panels 18, through any underlying membrane 12 and into the underlying deck 6, thereby anchoring panels 18 and 20. Preferably anchor plate 22 includes holes 68 in each corner of the anchor plate and in the center of the anchor plate, although other hole configurations and other sized anchor plates could be used as well.

FIG. 7 also illustrates a further alternative embodiment in which anchor plates 22*b*, also shown in dashed lines, are shown in an exemplary arrangement, one at each corner of panels 20. While anchor plates 22, 22*a* each have five fasteners 70, plates 22*b* have only two fasteners 70 because of the greater number of plates 22*b* used with each panel 20. It is preferred that each anchor plate have at least two fasteners 70. The use of a plurality of fasteners 70 with each anchor plate 22, 22*a*, 22*b* combines good hold down force, from the use of a plurality of fasteners 70, with the advantage of a large surface area pressing against panel 20.

Figure 8A:
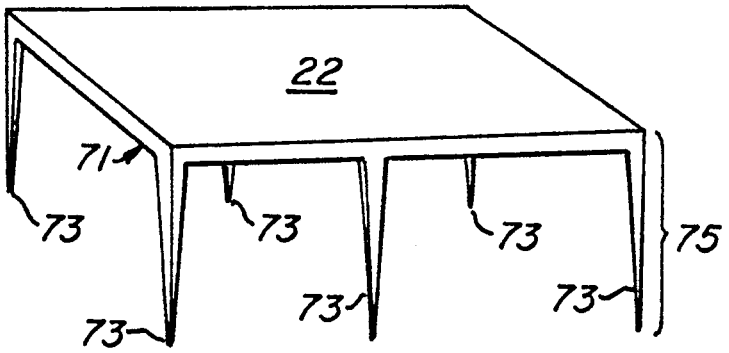
FIGS. 8A and 8B are perspective views of alternative forms of an anchor plate according to the present invention.
Figure 8B:
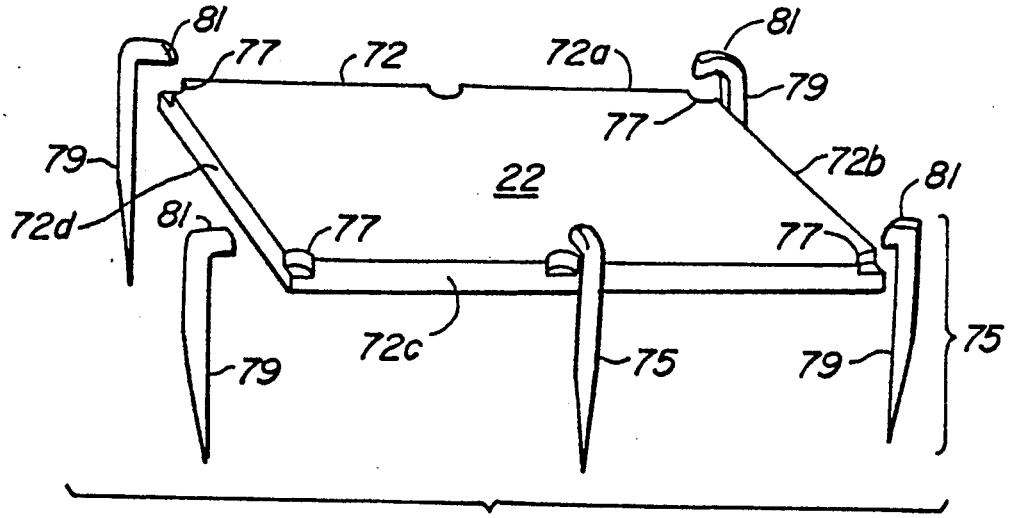

FIGS. 8A and 8B show alternative forms of anchor plate 22. According to FIG. 8A, the lower surface 71 of anchor plate 22 has sharpened spikes 73 integrally formed therewith. The spike body length 75 is sufficient to penetrate underlying panels 20, 18 (if present) and at least a portion of deck 6. Anchor plates 22 so formed may be installed without separate fasteners. The anchor plates 22 are positioned and the roof installer forces spikes 73 through the underlying panels 20, 18, and a portion of deck 6 using force from the installer's feet, or a hammer. According to FIG. 8B, perimeter edges of upper surface 72 of anchor plate 22 have recesses 77 sized to accommodate the head portion 81 of a generally L-shaped spike 79 having a spike length 75. Anchor plates 22 so formed are positioned and are held in place by pounding spikes 79 through the underlying panels 20, 18 (if present) and at least a portion of deck 6. The head portion 81 of each spike 75 lies preferably flush with upper surface 72.

Figure 6:
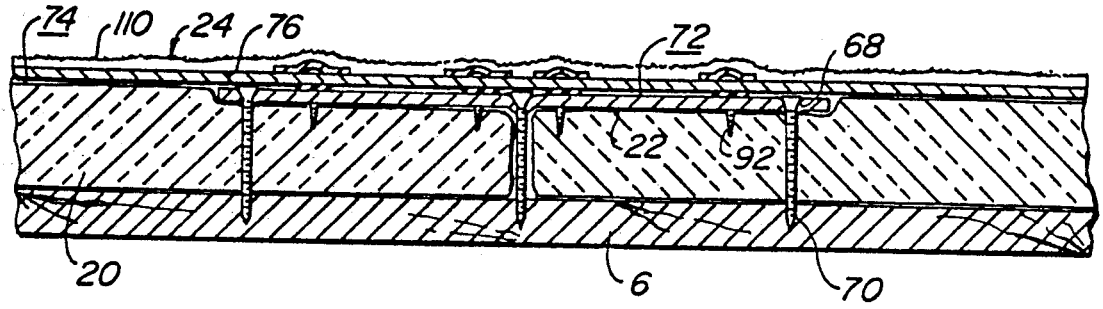
FIG. 6 is a cross section of a portion of a roof installation according to the present invention showing the flush installation of an anchor plate.
Figure 7:
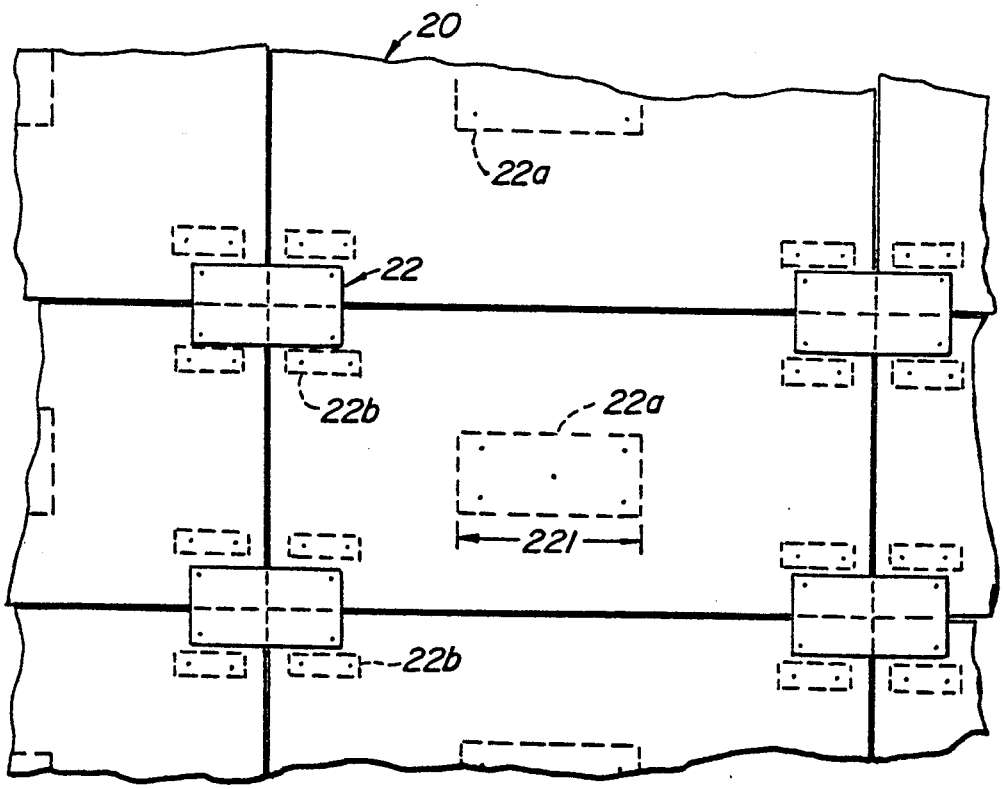
FIG. 7 is a plan view of a roof installation according to the present invention prior to installation of the roof covering.

As best seen in FIGS. 5 and 6, it is preferred that the upper surface 72 of anchor plate 22 be substantially flush with the upper surface 74 of filler panels 20. Since filler panels 20 are slightly compressible under force, upper surface 74 is readily brought into a flush disposition by sufficiently tightening fasteners 70 into deck 6. In this flush disposition, an essentially contiguous surface is defined by upper surface 74 of filler panels 20 and upper surface 72 of anchor plates 22. It is possible, however, to install the new roofing system 14 with anchor plates 22 in a non-flush disposition. FIG. 7 shows roofing system 14 after anchor plates 22 have been installed.

Figure 9B:
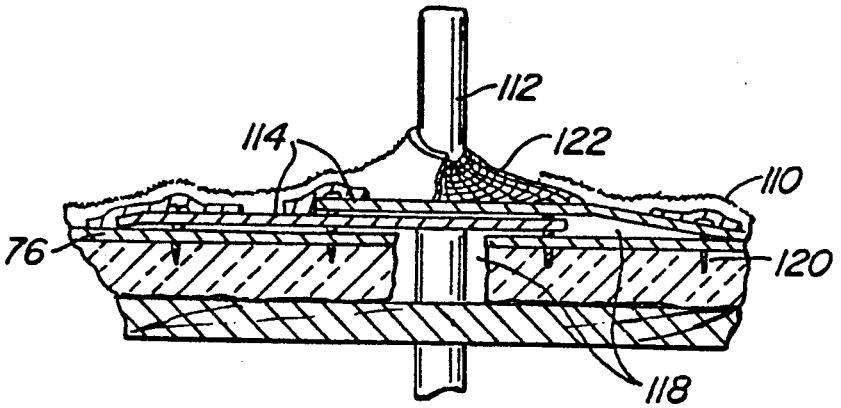
FIG. 9B is a cross-sectional view of the vent pipe installation of FIG. 9A.
Figure 9A:
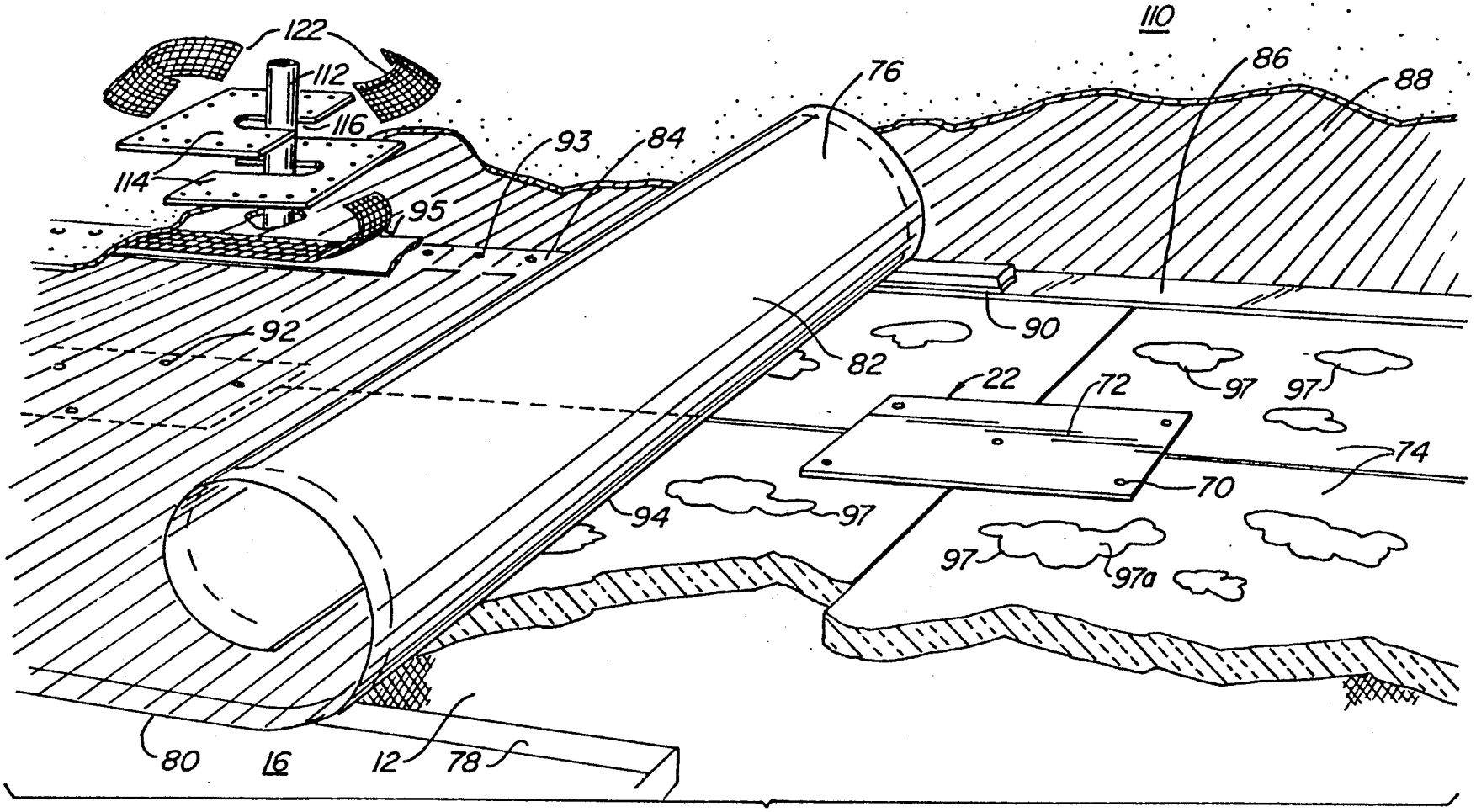
FIG. 9A shows installation of the roof covering according to the present invention.

With reference to FIG. 9A, an outer skin or roof covering 76, preferably rolled galvanized metal of about 30 ga. which is available in widths of about 10', 12' and 14', is next installed. Covering 76 is preferably rolled onto the upper surface 74 of filler panels 20 and the upper surface 72 of anchor plates 22. As shown in FIG. 9A an edge 80 of a first length 82 of roofing covering 76 lies atop upper surface 78 of perimeter members 16. The opposite edge 84 of length 82 will preferably cover (or be covered by) a marginal portion 86 of an adjacent length 88 of covering 76. Preferably a layer of water resistant caulking adhesive/sealant 90 is laid down between the marginal overlapping portion 86 of adjacent lengths 76, 82. Adhesive/sealant 90 promotes watertightness between adjacent lengths of roofing material 76. Typically the width of the marginal portion 86 is about 3 to 4 inches.

After lengths of roofing material 76 have been laid down with adhesive 90 between marginal portions 86, roof material 76 is attached to the underlying anchor plates 220 with screws 92. In addition, it is preferred that fasteners such as sheet metal screws 93 be used to secure the marginal portions 86 of adjacent lengths 82, 88 of material 76 to one another. The protruding ends of screws 93 penetrate harmlessly into the underlying panels 20. Preferably a strip 95 of a water resistant membrane sealer, such as Sonneborn NP-1 and/or SL-1 made by Rexnord Chemical Products Inc. of Minneapolis, Minn., is laid down atop sheet metal screws 93 to minimize any water leakage through the interface of screws 93 and roofing material 76 into panels 20 and deck 6. Optionally, an adhesive 97 may be applied between the upper surface 74 of panels 20 and the lower surface 94 of roofing material 76 to help anchor material 76 at regions intermediate to the locations of the anchor plates 22.

As best seen in FIG. 5, it is preferred that an end flashing member 98 be included adjacent perimeter member 16 to minimize the likelihood of water leaking into deck 6. Preferably flashing member 98 is generally "L" shaped having a generally horizontally disposed portion 100 that overlies roofing material 76 and a substantially vertically disposed portion 102 that overlies portion 17 of perimeter member 16. As further shown in FIG. 5, it is preferred that any gutter 104 incorporated into the new roofing system 14 have its wall facing portion 106 disposed preferably beneath portion 17 of perimeter member 16, and therefor beneath end flashing member 98. So disposed, gutter 104 is unlikely to cause water to leak into deck 6. Preferably an adhesive/sealant 108 is spread between the interface of gutter portion 106 and perimeter member portion 17 to block any water seepage path into deck 6.

After roofing material 76 is attached, as above described, it is preferred that the upper surface 96 of material 76 be covered with at least one layer of a coating material 110, as shown in FIGS. 2, 5, and 9A. Preferably coating 110 is a material such as Energy Wave Insulating Paint, manufactured by the Energy Wave Corporation located at 954 So. Highway 41, Inverness, Fla. 32650, although other coatings could also be used. Coating 110 may be rolled, brushed or sprayed onto surface 96, and provides additional protection against the elements, and contributes to the sealing or encapsulation of any asbestos particles that might have been contained in the underlying deck 6 or membrane 12.

Roof installations typically have vent pipes 112 or the like protruding from deck 6, panels 20 and roof material 76. As shown in FIGS. 9A and 9B, according to the present invention two flashing pieces 114 are placed on opposite sides of pipe 112 atop roof material 76, with pipe 112 protruding through the openings 116 in pieces 114. Pipe 112 serves to vent structure 2. The use of pieces 114 allows an installer to rapidly flash around pipe 112, even if, for example, the pipe is bulbous above the level of roof material 76. It is preferred that adhesive caulking/sealant 118 be liberally applied around pipe 112 and above and below pieces 114, as shown in FIG. 9B, and that sheet metal screws 120 attach pieces 114 to each other and to roofing material 76. To further promote water resistance, it is preferred that a layer of water resistant membrane 122 be placed around pipe 112 as it exits the uppermost flashing piece 114. Membrane 112 is preferably the same material as described above with reference to membrane strip 95. As shown in FIGS. 9A and 9B, one or more layers of coating 110 are applied over membrane 122 to further render roof system 14 watertight.

Figure 10:
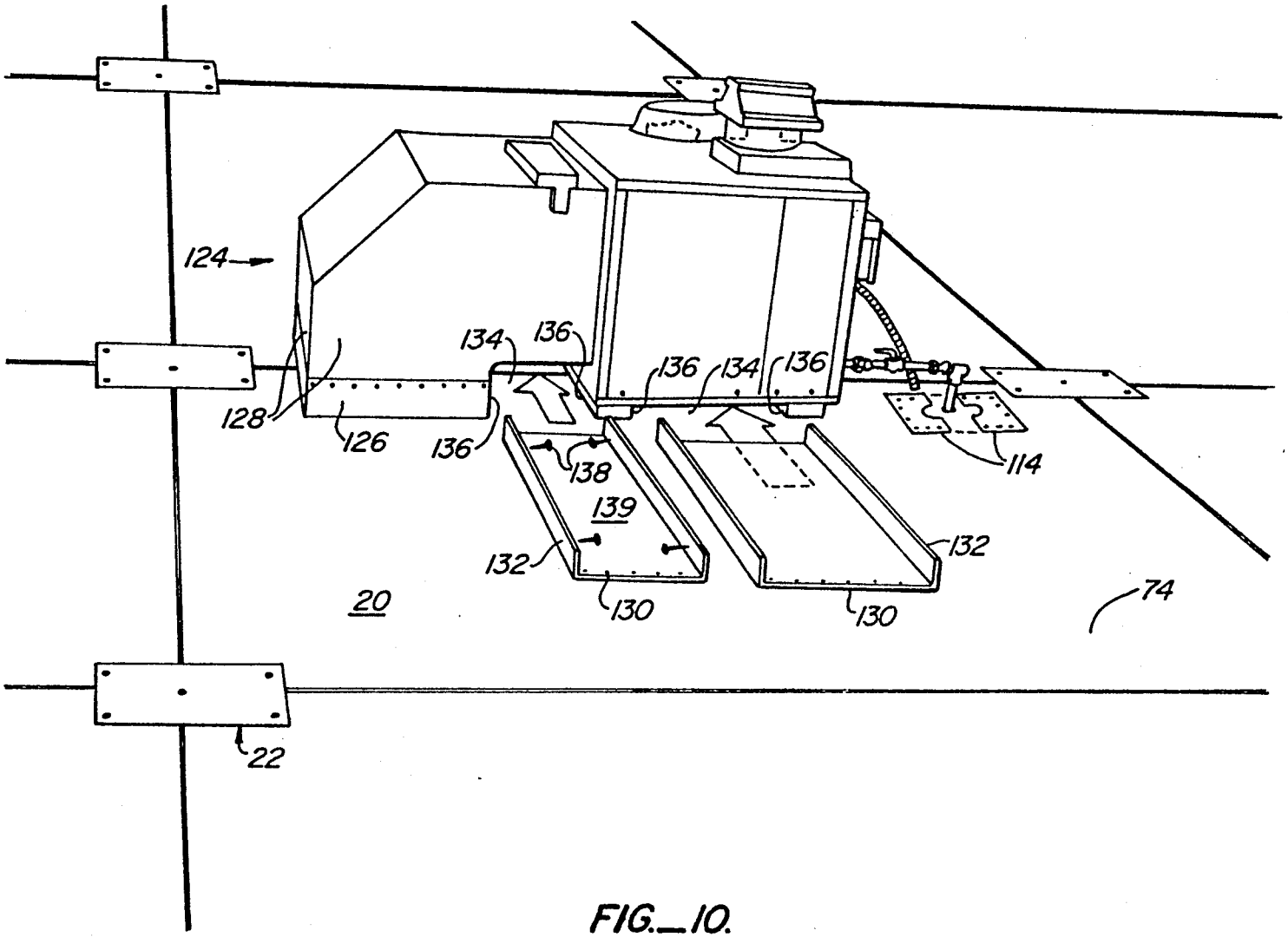
FIG. 10 shows installation of a roofing system according to the present invention where roof mounted fixtures are present.

As shown by FIG. 10, existing structures 2 frequently have protruding roof mounted fixtures 124 such as air conditioners. Flashing 126 is applied to the fixture sidewalls 128 in the convention manner. However, according to the present invention a catch pan 130 having pan sidewalls 132 is preferably disposed beneath any openings 134 present between the underside of fixture 124 and the upper surface 74 of filler panels 20. The pans 130 are sized to fit openings 134 and are preferably made of galvanized sheet metal. Pans 130 include pan sidewalls 132 which are attached to adjacent sidewalls 136 of fixture 124, preferably with sheet metal screws 138. Thereafter roof material 76 and preferably coating 110 are applied around pans 130. Pans 130 contribute to rapid water sealing of the frequently inaccessible openings 134 beneath fixtures 124. Because pans 130 attach at the pan sidewalls 132, rather than pan bottoms 139, the water catching integrity of the pans is preserved. Pans 130 serve the dual purposes of a flashing and roof covering.

Changes and modifications in the specifically described embodiments may be carried out without departing from the scope of the invention, which is intended to be limited only by the scope of the appended claims.

What is claimed is:

1. A roofing system for installation on a roof deck of a structure, comprising:

a plurality of adjacent filler panels, each having an upper surface, a lower surface, a plurality of corners, and a plurality of perimeter edges, said perimeter edges having lengths, said panels being disposed atop said roof deck such that substantially all of said edges abut a perimeter edge of an adjacent filler panel, said filler panels providing a substantially continuous surface covering said roof deck;

an anchor plate disposed on said upper surfaces covering portions of said perimeter edges of at least two of said adjacent filler panels;

said anchor plate having a length substantially less than half the length of each of said perimeter edges covered thereby so that a majority of said perimeter edges are free of overlapping anchor plate material;

a plurality of fasteners, securing said anchor plate and said adjacent filler panels to said roof deck;

a skin layer covering said adjacent filler panels and said anchor plate, said skin layer disposed over said upper surfaces of said adjacent filler panels; and attachment means penetrating said skin layer for securing said adjacent skin sections to said anchor plate.

2. The system of claim 1, wherein said anchor plate covers portions of said perimeter edges of at least three said adjacent filler panels.

3. The system of claim 1, wherein said anchor plate is disposed on the upper surface of a corner portion of at least two adjacent filler panels.

4. The system of claim 1 wherein:

said anchor plate and said fastener are integral;

said fastener including a spike extending from a lower surface of the anchor plate; and said spike permitting the anchor plate to be secured by applying a force to an upper surface of the anchor plate sufficient to drive said spike through an underlying filler panel and into at least a portion of the roof deck.

5. The system of claim 1, wherein:

an upper edge surface of said anchor plate includes a recess sized to receive a head of a generally L-shaped spike; and said fastener is a generally L-shaped spike for securing the anchor plate;

a head of said spike lying in said recess and a body of the spike being driven through an underlying filler panel and into at least a portion of the roof deck.

6. The system of claim 1 wherein a plurality of said fasteners are used with said anchor plates.

7. The system of claim 1, wherein said filler panels are sheets of polystyrene foam.

8. The system of claim 1, further including hat shaped perimeter members, attached to the structure, disposed at and defining a perimeter of said deck.

9. The system of claim 1, wherein said upper and lower surface of at least one filler panel are not parallel to each other, thereby imparting a sloped surface to at least a portion of said roofing system.

10. The system of claim 1, where the roof deck includes a preexisting membrane.

11. The system of claim 10, further including a sealing material applied to an upper-most surface of the skin layer for encapsulating any asbestos present in the preexisting membrane.

12. The system of claim 1, further including a pair of flashings having slots therein, disposed above the skin layer on each side of a pipe protruding through the roof deck, said pipe serving as a vent.

13. The system of claim 1, further including a pan having sidewalls, disposed in a space beneath a fixture protruding from said roof and the upper surface of a filler panel, a sidewall of said pan being attached to a sidewall of said fixture.

14. The system of claim 1, wherein an upper surface of an anchor plate is mounted substantially flush with the upper surface of at least one underlying filler panel.

15. A roofing system for installation on a roof deck of a structure, comprising:

a plurality of filler panels, each having an upper surface, a lower surface, a plurality of corners, and a plurality of perimeter edges, said panels being disposed atop the roof deck such that substantially all of said edges abut an edge of an adjacent filler panel, said filler panels providing a substantially continuous surface covering said roof deck;

an anchor plate having an upper edge surface with a recess sized to receive a head of a generally L-shaped spike, said anchor plate being disposed on the upper surface of each of the filler panels;

a plurality of generally L-shaped spikes, securing said anchor plate and adjacent filler panels to the roof deck;

a head of said spike lying in said recess in said anchor plate and a body of said spike being driver through an underlying filler panel and into at least a portion of the roof deck; and a skin layer covering said filler panels and said anchor plate.

16. The roofing system of claim 15 wherein said anchor plate is arranged to cover portions of adjacent perimeter edges and wherein said anchor plate has a length to cover substantially less than half the minor length of the perimeter edges covered thereby so that a majority of said perimeter edges are free of overlying anchor plate material.

17. The system of claim 16, wherein said anchor plate covers portions of said perimeter edges of at least three adjacent filler panels.

18. The system of claim 16, wherein an anchor plate is disposed on the upper surface at the corners of at least two adjacent filler panels.

19. The system of claim 16, wherein:

said anchor plate and said spikes are integral;

said spikes extending from a lower surface of the anchor plate; and said spikes permitting the anchor plate to be secured by applying a force to an upper surface of the anchor plate sufficient to drive said spikes through an underlying filler panel and into at least a portion of the roof deck.

20. The system of claim 16, wherein said skin layer includes:

adjacent outer skin sections, each having an edge extending around said outer skin section perimeter, disposed over said upper surfaces of said adjacent filler panels such that a marginal region of said adjacent skin sections overlie one another; and attachment means penetrating said outer skin sections at intervals within said marginal region, for securing said adjacent skin sections to said anchor plate.

21. A method for installing a roofing system on a roof deck of a structure, comprising the following steps:

selecting a plurality of filler panels, each panel having upper and lower surfaces, a plurality of corners, and a plurality of perimeter edges, said edges having a length;

placing said filler panels atop the roof deck with said perimeter edges abutting a perimeter edge of an adjacent panel, such that said filler panels provide a substantially continuous surface covering the roof deck;

disposing an anchor plate on the upper surface covering portions of perimeter edge of at least two adjacent filler panels;

said anchor plate having a length substantially less than half the length of each of said perimeter edges covered thereby so that a majority of said perimeter edges are free of overlying anchor plate material;

securing said anchor plate with a fastener to a portion of the roof deck, securing thereby the filler panels contracted by the anchor plate to the roof deck;

placing a skin layer covering the filler panels and anchor plates;

said skin layer disposed over said upper surfaces of said adjacent filler panels;

securing said skin layer to the underlying anchor plates; and securing the skin layer to the underlying roof deck.

22. The method of claim 21, wherein said anchor plate covers portions of the perimeter edges of at least three adjacent filler panels.

23. The method of claim 21, wherein the step of disposing includes disposing an anchor plate on the upper surfaces of corner portions of at least two adjacent filler panels.

24. The method of claim 21, wherein the step of securing said anchor plate is accomplished with a fastener that is integrally attached to a lower surface of the anchor plate.

25. The method of claim 21, wherein the step of securing the skin layer includes securing a fastener through the outer skin sections at intervals within the marginal region, through an underlying panel and into at least a portion of the roof deck.

26. The method of claim 21, wherein the step of selecting filler panels includes selecting filler panels made of sheets of polystyrene foam.

27. The method of claim 21, including the further step of:

providing hat shaped perimeter members, disposed at and defining a perimeter of said deck, an upper surface of said members defining an upper surface of the installed roofing system;

attaching a portion of said members to the structure.

28. The method of claim 21, wherein the step of selecting filler panels includes selecting at least one filler panel whose upper and lower surfaces are not parallel to each other, said selected panel imparting a sloped surface to at least a portion of the roof system.

29. The method of claim 21, wherein the roof deck includes a preexisting membrane.

30. The method of claim 21, including the further steps of applying a sealing material to an outer surface of the skin layer for sealing any asbestos present in the preexisting membrane.

31. The method of claim 21, including the further step of providing a pair of opposing half-moon shaped flashings, and positioning the half-moon shaped flashings above the skin layer on either side of a vent pipe protruding through the roof deck.

32. The method of claim 21, including the further steps of:

providing a pan having sidewalls, sized to fit in a space beneath a fixture protruding from said roof and the upper surface of a filler panel; and attaching said sidewalls to a side portion of the fixture.

33. The method of claim 21, wherein said step of securing said anchor plate includes compressing an underlying filler panel such that an upper surface of the anchor plate is mounted substantially flush with the upper surface of at least one underlying filler panel.

34. The method of claim 33, including the further step of applying a layer of sealing material to an uppermost surface of the outer skin layer for encapsulating any asbestos present in the preexisting membrane.

35. A roofing system for insulation on a roof deck of a structure, comprising:

a plurality of adjacent filler panels, each having an upper surface, a lower surface, and a plurality of perimeter edges, said panels being disposed atop the roof deck such that edges abut a perimeter edge of an adjacent filler panel, said filler panels providing a substantially continuous surface covering the roof deck;

an anchor plate disposed on the upper surface of each of the filler panels;

a plurality of fasteners securing each of said anchor plates and the underlying filler panels to the roof deck; and a skin layer covering the filler panels and anchor plates attachment means penetrating said skin layer for securing said adjacent skin sections to said anchor plate.

36. The system of claim 35 wherein a plurality of said anchor plates are disposed on the upper surface of each said filler panels.

37. The system of claim 35 wherein the fasteners include screws.

38. The system of claim 35, further including a pan having sidewalls disposed in a space beneath a fixture protruding from said roof and the upper surface of a filler panel, a sidewall of said pan being attached to a sidewall of said fixture.

39. The system of claim 35, wherein an upper surface of an anchor plate is mounted substantially flush with the upper surface of at least one underlying filler panel.

40. A roofing system for installation on a roof deck of a structure, said roof deck having a preexisting membrane, comprising:

filler panels, each having an upper surface, a lower surface, corners and perimeter edges, said panels being disposed atop the roof deck such that the edges of adjacent filler panels are adjacent each other, said filler panels providing a substantially continuous surface covering the roof deck;

an anchor plate disposed on the upper surface covering portions of perimeter edges of at least two adjacent filler panels;

said anchor plate sized to cover substantially less than half the length of the perimeter edges covered thereby so that a majority of the length of said perimeter edges is free of overlapping anchor plate material;

a fastener, securing said anchor plate and the underlying edge portion of the adjacent filler panels to the roof deck;

a skin layer covering the filler panels and anchor plate; and a sealing material applied to an upper-most surface of the skin layer for encapsulating any asbestos present in the preexisting membrane attachment means penetrating said skin layer for securing said adjacent skin sections to said anchor plate.

41. The system of claim 40, wherein an upper surface of an anchor plate is mounted substantially flush with the upper surface of at least one underlying filler panel.

42. A roofing system for installation on a roof deck of a structure, comprising:

filler panels, each having an upper surface, a lower surface, corners, and perimeter edges, said panels being disposed atop said roof deck such that said edges of adjacent filler panels are adjacent each other, said filler panels providing a substantially continuous surface covering said roof deck;

an anchor plate disposed on said upper surface covering portions of said perimeter edges of at least two of said adjacent filler panels;

said anchor plate having a length substantially less than half the minor length of said perimeter edges covered thereby so that a majority of said perimeter edges are free of overlapping anchor plate material;

a fastener securing said anchor plate and the underlying edge portion of said adjacent filler panels to said roof deck;

a skin layer covering said filler panels and anchor plate; and a pan having sidewalls, disposed in a space beneath a fixture protruding from said roof and the upper surface of a filler panel, a sidewall of said pan being attached to a sidewall of said fixture attachment means penetrating said skin layer for securing said adjacent skin sections to said anchor plate.

43. The system of claim 42, wherein an upper surface of an anchor plate is mounted substantially flush with the upper surface of at least one underlying filler panel.

44. A roofing system for insulation on a roof deck of a structure, comprising:

filler panels, each having an upper surface, a lower surface, and perimeter edges, said panels being disposed atop the roof deck such that the edges of adjacent filler panels are adjacent each other, said filler panels providing a substantially continuous surface covering the roof deck;

an anchor plate disposed on the upper surface of each of the filler panels;

a plurality of fasteners securing each of said anchor plates and the underlying filler panels to the roof deck;

a skin layer covering the filler panels and anchor plates; and including a pan having sidewalls, disposed in a space beneath a fixture protruding from said roof and the upper surface of a filler panel, a sidewall of said pan being attached to a sidewall of said fixture attachment means penetrating said skin layer for securing said adjacent skin sections to said anchor plate.

* * * * *